US007658150B2

(12) United States Patent
Rönn et al.

(10) Patent No.: US 7,658,150 B2
(45) Date of Patent: Feb. 9, 2010

(54) DEVICE FOR CONTROL OF FRAGMENT DISCHARGE FROM MAIN CHARGE LINERS

(75) Inventors: Torsten Rönn, Karlskoga (SE); Christer Thuman, Karlskoga (SE); Peter Freij, Karlskoga (SE)

(73) Assignee: BAE Systems Bofors AB, Karlskoga (SE)

( * ) Notice: Subject to any disclaimer, the term of this patent is extended or adjusted under 35 U.S.C. 154(b) by 454 days.

(21) Appl. No.: 10/559,820

(22) PCT Filed: Jun. 9, 2004

(86) PCT No.: PCT/SE2004/000897

§ 371 (c)(1),
(2), (4) Date: Mar. 22, 2006

(87) PCT Pub. No.: WO2004/109218

PCT Pub. Date: Dec. 16, 2004

(65) Prior Publication Data

US 2006/0180045 A1 Aug. 17, 2006

(30) Foreign Application Priority Data

Jun. 11, 2003 (SE) ..... 0301691

(51) Int. Cl.
*F42B 12/00* (2006.01)

(52) U.S. Cl. ..... 102/476; 102/307; 102/475; 102/306

(58) Field of Classification Search ..... 102/476, 102/475, 306, 307
See application file for complete search history.

(56) References Cited

U.S. PATENT DOCUMENTS

| | | | | | |
|---|---|---|---|---|---|
| 3,186,304 | A | * | 6/1965 | Biehl | 102/306 |
| 3,443,518 | A | * | 5/1969 | Cross | 102/306 |
| 3,714,897 | A | * | 2/1973 | Parker | 102/475 |
| 4,034,673 | A | * | 7/1977 | Schneider, Jr. | 102/476 |
| 4,253,523 | A | * | 3/1981 | Ibsen | 102/310 |
| 4,359,943 | A | * | 11/1982 | Majerus | 102/309 |
| 4,448,128 | A | * | 5/1984 | Trinks et al. | 102/476 |

(Continued)

FOREIGN PATENT DOCUMENTS

| | | |
|---|---|---|
| SE | 525391 | 2/2005 |
| WO | WO-02/088622 | 11/2002 |

OTHER PUBLICATIONS

International Search Report No. PCT/SE2004/000897, dated Sep. 14, 2004, 2 pages.

*Primary Examiner*—Michael Carone
*Assistant Examiner*—Jonathan C Weber
(74) *Attorney, Agent, or Firm*—Connolly Bove Lodge & Hutz LLP

(57) ABSTRACT

The material or fragment discharge is controlled by means of a device (4) in connection to the triggering, such as by means of an initiation charge (5), of the main charge (3) in the ammunition unit (1). The liner is devised as being exposable for effect from the explosive charge or charges (6) that are devised as being able to be initiated upon or shortly prior to the triggering of the main charge. The explosive charge achieves, upon initiation a pre-deformation of the liner (4) prior to the liner being affected by the triggering of the main charge for the material or fragment discharge The fragment forms can be rendered more effective in relation to design solution known by prior art by means of the choice explosive charge form and placement.

17 Claims, 2 Drawing Sheets

U.S. PATENT DOCUMENTS 4,470,353 A * 9/1984 Fogal et al. ..... 102/476
4,499,830 A * 2/1985 Majerus et al. ..... 102/476
4,860,654 A * 8/1989 Chawla et al. ..... 102/476
4,860,655 A * 8/1989 Chawla ..... 102/476
4,862,804 A * 9/1989 Chawla et al. ..... 102/476
4,982,667 A * 1/1991 Weimann ..... 102/476
5,450,794 A * 9/1995 Drimmer ..... 102/309
5,479,860 A * 1/1996 Ellis ..... 102/313
5,509,357 A * 4/1996 Lawther ..... 102/307
5,544,589 A * 8/1996 Held ..... 102/492
5,939,663 A * 8/1999 Walters et al. ..... 102/476
6,186,070 B1 2/2001 Fong et al.

* cited by examiner

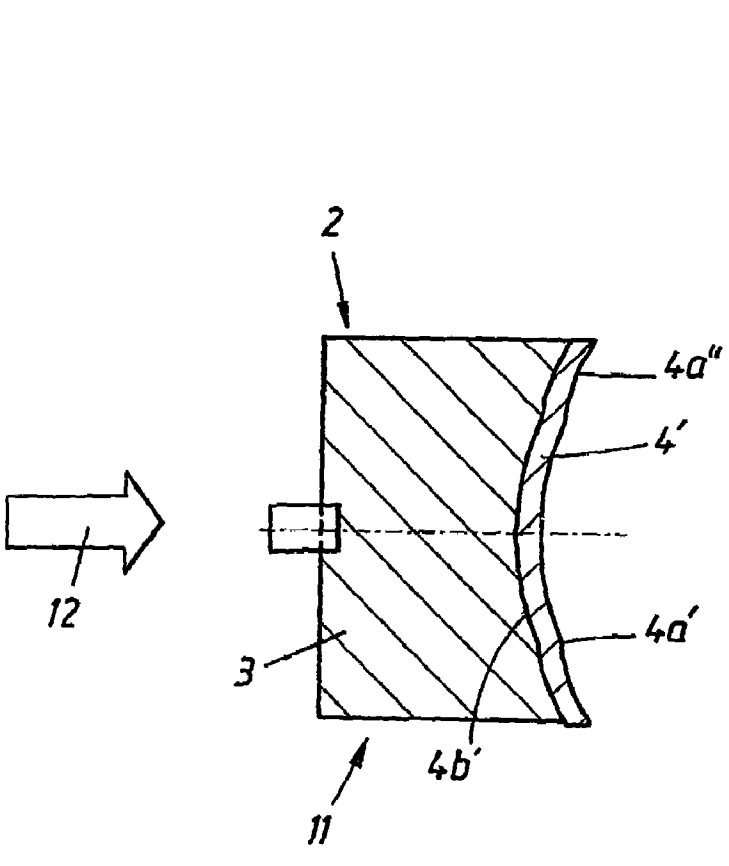
Fig. 1
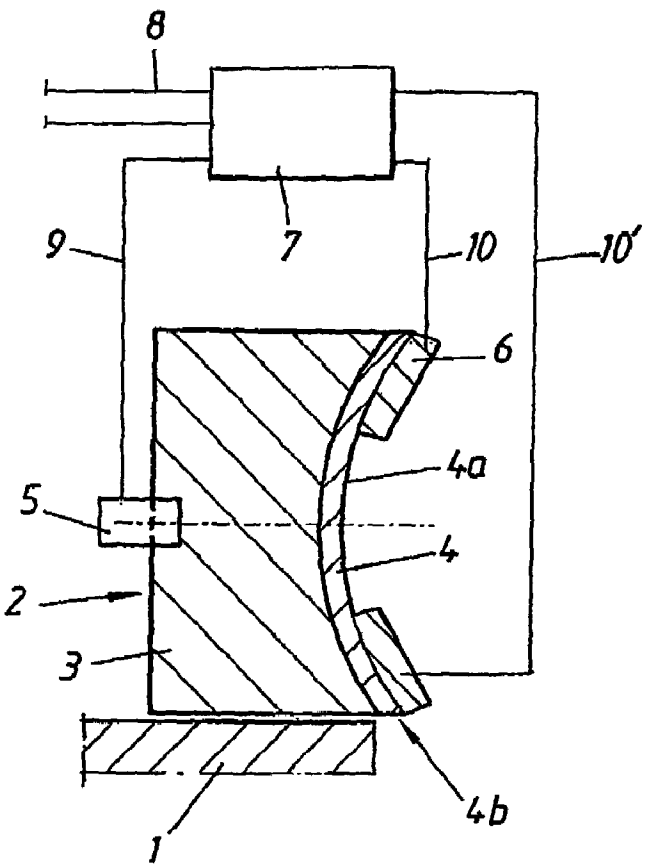

80
40
0
-40
-80
60
-60
19
20
21
22
19'
20'
21'
22'
24
6'
15a
15
16
6b
6''
6a
18
14
13
23
6'''
15a'
6b'
6c
6''''
6a'
15''
18'
14'

DEVICE FOR CONTROL OF FRAGMENT DISCHARGE FROM MAIN CHARGE LINERS

TECHNICAL AREA

The present invention relates to a device for control of material or fragment discharge from a primary liner or secondary liner in connection with the triggering, by means of an initiation charge, of a main charge in an ammunition unit, which can include, e.g., a missile, projectile, etc.

PROBLEM PRESENTATION, BACKGROUND TO INVENTION AND KNOWN TECHNOLOGY

There are, by prior art, known manners of devising ammunition units/projectiles to accomplish different combat situations, e.g., in a first case to effect a Shaped Charge Warhead (SCW) function against hard targets and in a second case to effect fragmentation function against soft targets. It is also known by prior art to propose the use of a deformed primary liner or secondary liner with a unit equipped with a main charge that achieves Shaped Charged Warhead (SCW) effect. The liner is made with pre-deformed shape and shall facilitate the design of a penetration projectile for hard objects in relation to the use of the ammunition unit. Prior art entails reference to U.S. Pat. No. 4,982,667.

INVENTION'S OBJECTIVE AND DISTINGUISHING CHARACTERISTICS

There exists a need, in producing ammunition units with main charge and liner(s), to improve the effectiveness of the fragment of projectile form and the Shaped Charge Warhead effect that is obtained from the liner in relation upon the activation of the main charge. The instructions for the use of a deformed liner are, in and of themselves, insufficient. The liner shall, in relation to the present invention, not employ a deformed profile of a predetermined nature; rather the deformation shall only result during as a function stage that included in an integrated function chain. It is, e.g., of great importance that dispersion angles of discharged fragments can be controlled and kept relatively small. Further, it is often desired that the divergent fragments may be given relatively low velocities, in order to achieve a forward-directed effect toward the target to be combated. It is also of importance to be able to control the fragment form so as to combat different types of targets. One objective of the present invention is to address this problem.

The objectives so named, as well as other, here, non-enumerated purposes are achieved within the framework indicated in the present independent patent claims. Embodiments of the invention are indicated in the dependent patent claims.

That which can be mainly regarded as characteristic features for a device in accordance with the present invention is that:

the liner is devised as being exposable for effect from the explosive charge or charges that is or are arranged as being able to be initiated upon or shortly prior to the triggering of the main charge. The invention is further distinguished by having, upon initiation(s) of the explosive charge or charges, caused a pre-deformation of the liner prior to the liner being affected by the triggering of the main charge with a material or fragment discharge.

According to other preferred aspects for a device in accordance with the invention it applies that:

the explosive charge or charges can be attached to the liner's front side or the concave side at the liner's periphery;

the explosive charge or charges may be attached to the liner periphery with a median barrier;

the barrier may be made of lead, approximately 1 mm thick, and neoprene, approximately 4 mm thick;

and, each explosive charge may be formed with an exterior surface, facing lengthwise to the main charge, and an angled surface, at the outer parts of the exterior surface facing the concave surface of the liner, that dilates itself outwards from the concave surface, leaving a central aperture in the ammunition unit's direction of flight that dilates outwards like a truncated cone. Small angles of dispersion are obtained in this case:

the divergent fragment or material discharge, resulting from main charge initiation, achieves small angles of dispersion, e.g. within the range of 0.4-9.0°, and lesser or low velocities, e.g. near 540-925 m/s;

the explosive charge's or charges' form can be varied and each explosive charge can, e.g., begin from the exterior circumference of the barrier with parallel interior and exterior surfaces and be attached with an end surface extending perpendicular to the interior and exterior surfaces and the interior and exterior surfaces allow a central aperture that extends cylindrically from the concave surface of liner in the ammunition unit's direction of flight. Angles of dispersion and velocities for the divergent fragments or material discharge are low in this case also;

the divergent fragment or material discharge resulting from the initiation of the main charge obtains angles of dispersion between 5.0-34° and velocities within the range of 380-650 m/s;

the liner shall deform upon initiation of the explosive charge or charges in a random manner dependent on the given cross section;

and, the concave and convex surfaces of the liner maintain the wave forms of the given cross section.

Further distinguishing characteristics are indicated in the following patent claims.

ADVANTAGES AND EFFECTS FROM THE INVENTION

By means of the proposals stipulated above, an effective combat system with different ammunition unit settings can be utilized, conferring both economic and technological advantages. Technology proven, by prior art, can in and of itself be used, which confer the possibility of using earlier ammunition handling routines and that the ammunition unit (missile, projectile, etc.) function can be independent of the specific knowledge of the personnel concerned. Arming and firing functions can be clearly ensured.

LIST OF FIGURES

A currently proposed embodiment of a device displaying characteristics that are significant for the present invention is described below with reference to the appended FIGS. 1-5 in which:

FIG. 1 principally shows a side view of the function process in a successive stages, for a partially depicted main charge component of an ammunition unit, illustrating initiation and explosive charges and a liner;

DETAILED EMBODIMENT DESCRIPTION

Figures 2, 3, 4, 5:
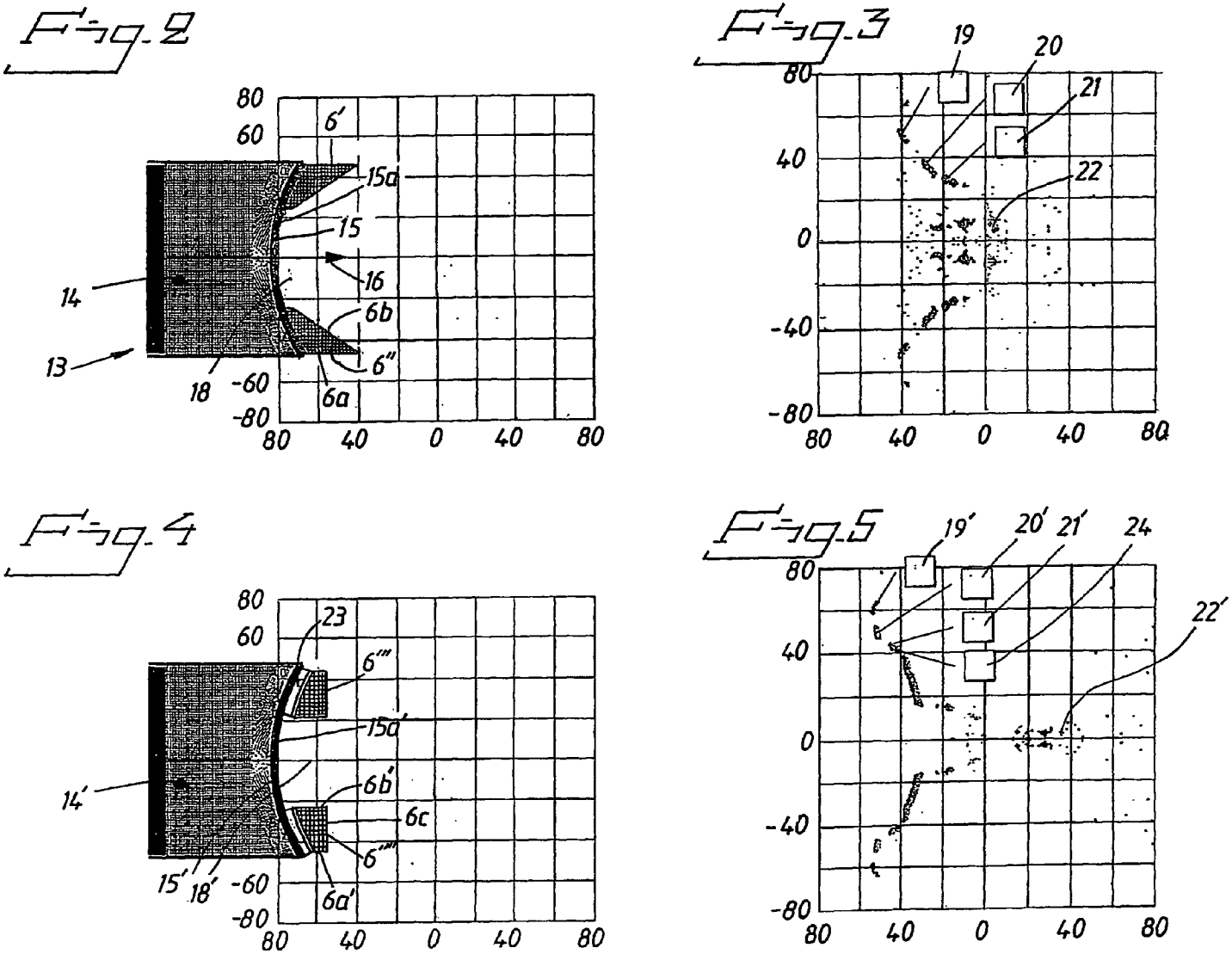
FIG. 2 shows, in lengthwise view, a first embodiment of explosive charges arranged at the main charge liner (primary or secondary)
FIG. 3 shows, in diagram form, the fragment or material discharge at or in connection to main charge initiation in accordance with FIG. 2.
FIG. 4 shows, in lengthwise view a second embodiment for arrangement of the explosive charge to the main charge liner; and, FIG. 5 shows, in diagram form, the fragment or material discharge at or in connection to main charge initiation in accordance with FIG. 4.

In FIG. 1 there is shown an ammunition unit, symbolically designated by 1, e.g. in the form of a missile, projectile, etc., that includes a main charge unit 2 equipped with a main charge 3 and a liner (primary or secondary) 4. The main charge 3 is, in and of itself, can be initiated according to prior art, preferably in the form of an initiation charge 5. In accordance with the basic concept of the present invention one or more explosive charges 6 are attached to the concave interior surface 4*a* of the liner. The explosive charge or charges can, in accordance with a preferred embodiment, be attached to the liner periphery 4*b*. In the case of one explosive charge, the said explosive charge extends in a ring-shaped fashion around the liner at the exterior periphery. In the case of two or more explosive charges 6, these are distributed as identical forms along the circumference of the liner. The initiation charge can be initiated, in and of itself, by means known through prior art, e.g., electronically. In the illustrated example, electrical triggering equipment 7 is utilized, which is illustrated in principle and which equipment is a component of the ammunition unit 1. Said equipment is powered, in and of itself, by means known through prior art in the ammunition unit through a conductor 8. The initiation charge 5 is connected to the equipment 7 by one or more conductors 9. In a similar fashion, the explosive charge or charges are initiateable by means of the equipment 7 by means of one conductor 10 or more conductors 10'. The triggering equipment can be controlled wirelessly from the ground, by setting a timing circuit upon arming, target sensing function, etc.

The arrangement illustrated in FIG. 1 is devised to function in two stages. In a first stage the explosive charge is or charges 6 are initiated. Then the charge 5 is initiated, which, in turn, causes the triggering of the main charge 3. FIG. 1 shows the case when the first function stage is achieved. Initiation of the explosive charges confers the deformation of the liner 4', which deformation is illustrated at the later point and symbolically designated by 11, whereupon the elapsed time is symbolically designated by the arrow 12. In accordance with the basic concept of the present invention, the liner distributes the deformation, upon the initiation of the charge 5, depending on the explosive charge or charges size(s) and position(s). The deformation is random and can be assumed to have different forms for different ammunition units and main charge units 2. FIG. 1 shows a wave-form section symbolically designated with 4*a'* and a reduction symbolically designated with 4*a''*. The irregularities in question can also appear on the rear of the liner 4*b'*. The explosive charge or charges 6 shall, in principle, be activated slightly prior to the main charge 3. This time delay can be achieved with the equipment 7, with a time delay function in the activation of the main charge 3, etc. When the liner 4' is deformed, the main charge 3 is thus initiated for triggering. Triggering is, thus, effected when the liner assumes its deformed condition. Compare the function stage 11 in FIG. 1. The time elapsing between the explosive charge or charges 6 initiation and the triggering of the main charge 3 can be within the time interval of 0.1-0.5 ms. It is possible, in an alternative form, to allow the explosive charge or charges 6 to be activated by impact function. The equipment 7 can be so embodied by means known, in and of themselves, by prior art.

FIG. 2 illustrates the form of explosive charge 6' or charges 6", respectively. In this case, the main charge has symbol designation 14 and the ammunition unit, as such, has symbol designation 13. The main charge 14 has a forward direction indicated with an arrow 16. The charge 6' or charges 6" are embodied with a straight surface or straight surfaces 6*a*. There is an angles surface 6*b* extending from the end of each charge at an angle toward the liner's concave surface 15*a*. Liner 15 has center sections that face towards a recess 18 that takes a truncated conical form depending on the charge 6' or charges 6" form or forms. The main charge is initiated by the deformation of the secondary liner or almost immediately thereafter.

The angles of dispersion, in accordance with FIG. 3, for the material or fragments shall be small; compare fragments 19, 20 and 21. The fragments 19 begins with a velocity of approximately 541 m/s, fragments 20 show a velocity of 770 m/s and fragments 21 show a velocity near to approximately 923 m/s. The angles of dispersion for the divergent fragment or fragments deviate in accordance with fragment 19 with approximately 9.1°. Fragments 20 deviate by 0.43° and fragments 21 deviate by 0.69°. From the arrangement, an effective dispersion 22 is obtained of the fragments discharged from the liner.

The embodiment example in accordance with FIG. 4 has the explosive charge 6''' or charges 6'''' attached to the interior or concave surface 15*a'* of the liner 15' by a barrier 23 that in one embodiment example may consist of a lead layer with a thickness of one to a few millimeters, e.g., 1 mm, and a neoprene layer that can be thicker, e.g., 4 mm. It is, here, mentioned that other thicknesses and materials with similar functions are entailed within the basic concept of the present invention. The parameters may therefore be varied for the different fragments. Thus the velocities can be reduced in relation to the embodiment in accordance with FIGS. 2 and 3. The velocity for fragment 19' may assume the value of 384 m/s and the corresponding values for fragments 20', 21' and 24 are 405, 582 and 642 m/s, respectively. The angles of dispersion may also increase slightly in relation to the embodiment in accordance with FIGS. 2 and 3, and, thus, the angles of dispersion 19', 20' 21' and 24 are 33.8°, 13.9°, 4.5° and 5.7°. The liner 15' has a midsection 15*a'* that opens outward toward a cylinder formed recess 18' by having the explosive charge or charges side surfaces 6*a'* and 6*b'* being parallel and ending in a straight end surface 6*c*, essentially extending perpendicular to the ammunition unit's direction of flight (compare with the arrow 16 in FIG. 2). This arrangement obtains dispersion 22' in the direction of the warhead effect. It shall be possible, by means of the present invention capacity for choosing the configuration of the explosive charges, and the said barrier or barriers, to maintain different fragment forms from the liner-emanative material, that is to say, with reference to the selection made, a variation in velocity obtains as does an angle of dispersion for different fragments from separate parts of the liner 15 and 15', which determine the given warhead effect as a distribution between Shaped Charge Warhead effect or fragmentation effect, as the ammunition units are to be so enabled. These variations shall be able to be installed during production or made during arming.

In the embodiment shown in FIG. 4, the main charge has symbol designation 14'.

ALTERNATIVE EMBODIMENTS

The embodiment of the liner can be in a material that is, in and of itself, known by prior art to be appropriate to the context, e.g., copper, metal alloy, aluminium, zinc, tantalum, tungsten etc. The embodiment of the barrier can likewise be made with another material than those indicated and with other values regarding material thickness.

The present invention is not limited to the design examples illustrated above, but can be subjected to modifications within the framework of the subsequent Patent Claims and the invention's basic concept.

The invention claimed is:

1. A device in combination with a liner having a shape with a rear convex surface and a front concave surface to control material or fragment discharge in an ammunition unit's direction of flight from a primary or secondary liner in connection with triggering, by initiation of a main charge of the ammunition unit wherein an explosive pre-charge or pre-charges are arranged at the front side of the liner at a periphery of the liner and that the liner is devised as being exposable for effect from the explosive pre-charge or pre-charges that are devised as being able to be initiated upon or shortly prior to the triggering of the main charge and wherein the explosive pre-charge or pre-charges obtain, upon initiation, a pre-deformation of the liner prior to the liner being affected by the triggering of the main charge for material or fragment discharge.

2. A device in accordance with claim 1, wherein the explosive pre-charge or pre-charges are arranged at the periphery of the liner with an intermediary barrier.

3. A device in accordance with claim 2, wherein the barrier is made of lead, approximately 1 mm thick, and neoprene, approximately 4 mm thick.

4. A device in accordance with claim 3, wherein each explosive pre-charge or pre-charges begin from the exterior circumference of the barrier with parallel interior and exterior surfaces and are arranged with an end surface extending perpendicular to the interior and exterior surfaces and the interior and exterior surfaces allow a central aperture that extends cylindrically from the concave surface of liner in the ammunition unit's direction of flight.

5. A device in accordance with claim 3, wherein the divergent material or fragment discharge, resulting from the initiation of the main charge, obtains angles of dispersion between 5.0-34° and velocities within the range of 380-50 m/s.

6. A device in accordance with claim 3, wherein the liner is deformed upon the initiation of the explosive pre-charge or pre-charges in a random manner over given cross sections.

7. A device in accordance with claim 2, wherein each explosive pre-charge or pre-charges begin from the exterior circumference of the barrier with parallel interior and exterior surfaces and are arranged with an end surface extending perpendicular to the interior and exterior surfaces and the interior and exterior surfaces allow a central aperture that extends cylindrically from the concave surface of liner in the ammunition unit's direction of flight.

8. A device in accordance with claim 7, wherein the divergent material or fragment discharge, resulting from the initiation of the main charge, obtains angles of dispersion between 5.0-34° and velocities within the range of 380-650 m/s.

9. A device in accordance with claim 2, wherein divergent material or fragment discharge, resulting from the initiation of the main charge, obtains angles of dispersion between 5.0-34° and velocities within the range of 380-650 m/s.

10. A device in accordance with claim 2, the divergent fragment or material discharge, resulting from main charge initiation, is given small angles of dispersion within the range of 0.4-9.0° and low velocities of about 540-925 m/s.

11. A device in accordance with claim 2, wherein the liner is deformed upon the initiation of the explosive pre-charge or pre-charges in a random manner over given cross sections.

12. A device in accordance with claim 2, wherein concave and convex surfaces of the liner obtain wave forms in given cross sections.

13. A device in accordance with claim 1, wherein each explosive pre-charge is formed with an exterior surface extending lengthwise to the main charge, and an angled surface, at outer parts of the exterior surface facing a concave surface of the liner, that dilates itself outwards from the concave surface, leaving a central aperture in the ammunition unit's direction of flight that dilates outwards like a truncated cone.

14. A device in accordance with claim 1, wherein the divergent fragment or material discharge, resulting from main charge initiation, is given small angles of dispersion within the range of 0.4-9.0° and low velocities of about 540-925 m/s.

15. A device in accordance with claim 1, wherein the liner is deformed upon the initiation of the explosive pre-charge or pre-charges in a random manner over given cross sections.

16. A device in accordance with claim 1, wherein concave and convex surfaces of the liner obtain wave form in given cross sections.

17. A device in accordance with claim 1, wherein the ammunition unit is a missile or a projectile.

* * * * *